United States Patent [19]

Jacobs

[11] Patent Number: 4,463,474

[45] Date of Patent: Aug. 7, 1984

[54] VACUUM CLEANER

[76] Inventor: Paul G. Jacobs, 9958 Amestay Ave., Northridge, Calif. 91324

[21] Appl. No.: 385,493

[22] Filed: Jun. 7, 1982

[51] Int. Cl.[3] ..... A47L 7/00

[52] U.S. Cl. ..... 15/353; 55/319; 55/320

[58] Field of Search ..... 15/321, 353, 339, 320; 141/98, 286, 325-327; 99/467, 472-474; 220/366; 16/386; 55/319, 320

[56] References Cited

U.S. PATENT DOCUMENTS

| | | | |
|---|---|---|---|
| 173,211 | 2/1876 | Chichester | 99/467 X |
| D. 242,210 | 11/1976 | Parise et al. . | |
| D. 243,311 | 2/1977 | Bartlett . | |
| 1,316,442 | 9/1919 | Goughnour | 15/353 X |
| 2,863,524 | 2/1955 | Buda . | |
| 3,006,020 | 3/1960 | Fillery . | |
| 3,117,337 | 1/1964 | Krammes | 15/353 X |
| 3,177,635 | 4/1965 | Cawl et al. | 15/339 X |
| 3,180,071 | 10/1960 | Nolte . | |
| 3,206,787 | 1/1963 | Daniels et al. . | |
| 3,821,830 | 7/1974 | Sundheim . | |
| 3,896,520 | 7/1975 | Williams . | |
| 3,896,521 | 7/1975 | Parise . | |
| 3,909,219 | 9/1975 | Fromknecht . | |
| 3,930,281 | 1/1976 | Principe et al. . | |
| 4,019,218 | 4/1977 | Cyphert . | |
| 4,041,569 | 8/1977 | Petersen . | |
| 4,055,405 | 10/1977 | Thun-Hohenstein . | |
| 4,083,705 | 4/1978 | Parise et al. . | |
| 4,138,761 | 2/1979 | Nauta . | |
| 4,200,951 | 5/1980 | Burgoon et al. | 15/321 |
| 4,287,635 | 9/1981 | Jacobs | 15/321 |

FOREIGN PATENT DOCUMENTS

| | | |
|---|---|---|
| 7706194 | 12/1978 | Netherlands . |

*Primary Examiner*—Chris K. Moore

*Attorney, Agent, or Firm*—Fulwider, Patton, Rieber, Lee & Utecht

[57] ABSTRACT

A vacuum cleaner is provided which includes an easily removable recovery tank mounted on a support structure and having a cover on the tank forming a vacuum chamber in the tank, the cover being hinged to the support structure by a hollow hinge. A vacuum fan is mounted on the support structure and draws air from the vacuum chamber through the cover and through the hollow hinge.

16 Claims, 4 Drawing Figures

VACUUM CLEANER

BACKGROUND OF THE INVENTION

This invention relates generally to vacuum cleaners, and more particularly, to commercial vacuum cleaners having a relatively large soil retention tank and a relatively large and powerful vacuum fan.

As is well known in the art, it is highly desirable for any vacuum cleaner to be easily handled for moving about in the work area, and it is also desirable that the soil retention container of the vacuum cleaner be easily and conveniently emptied and restored in the vacuum cleaner in condition for use. In vacuum cleaning devices known heretofore it was necessary either to remove a clumsy and dirty soil retention bag from the vacuum cleaner, or to disconnect hose attachments from a removable recovery tank in order to remove the tank to be emptied. In either of the above cases, it was highly likely that soil would be spilled in the area of the vacuum cleaner, and therefore it was necessary to transport the entire vacuum cleaner device out of the area being cleaned to a disposal area for emptying the soil retention container. In the latter case described above, the attachments had to be reconnected before the cleaning operation could resume.

Accordingly, there has existed a need for a vacuum cleaning device which is convenient to operate and which includes a soil retention tank which can be easily and neatly removed from the vacuum cleaner, transported to a disposal area for emptying, and replaced in the vacuum cleaner in condition for continued use. As will become apparent from the following, the present invention satisfies that need.

SUMMARY OF THE INVENTION

The present invention resides in a new and improved vacuum cleaner which can be easily handled when in use, and which includes a recovery tank arranged to be conveniently removed from the vacuum cleaner to be emptied without having to disconnect any vacuum conduits or the like. Moreover, the vacuum cleaner of the present invention is relatively inexpensive to manufacture, is trouble-free and reliable in use, and can be adapted for use in cleaning both wet and dry surfaces.

More specifically, the vacuum cleaner of the present inventon includes a support structure upon which is carried an open top recovery tank for retaining soilded solid or liquid material. A cover overlies the open top of the recovery tank forming a vacuum chamber in the tank, and the cover is hinged to the support structure by a hollow hinge. A vacuum fan is mounted in a relatively low position on the support structure and draws a vacuum within the vacuum chamber through the cover and through the hollow hinge. The cover also includes an opening into the vacuum chamber which is in communication with a flexible vacuum hose attached to a vacuum cleaning tool for cleaning a wet or dry surface. If desired, the controls for operating the vacuum fan can be mounted on the cover, and the wires for connecting the controls to the fan motor can be led through a portion of the hollow hinge.

Other features and advantages of the present invention will become apparent from the following detailed description, taken in conjunction with the accompanying drawings, which illustrate, by way of example, the principles of the invention.

DETAILED DESCRIPTION

Figure 1:
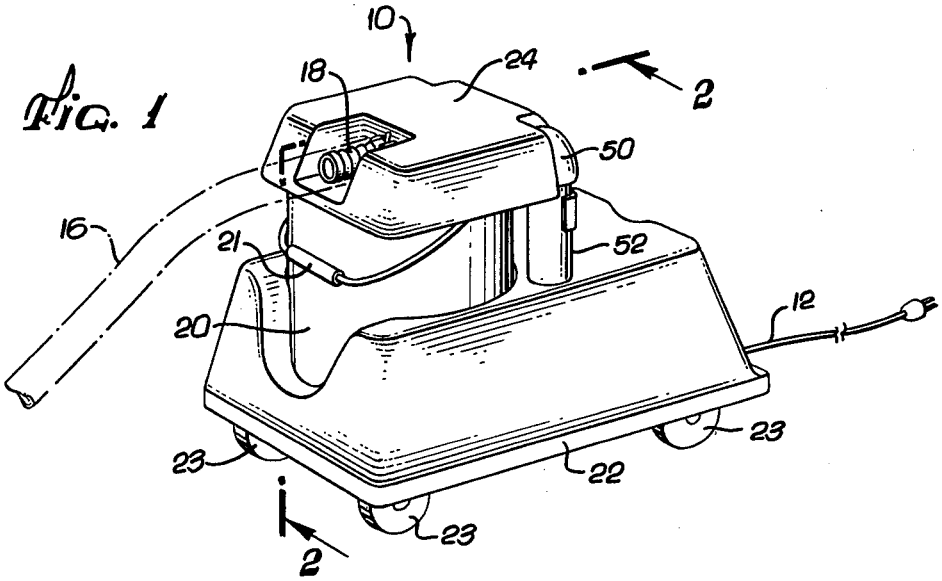
FIG. 1 is a perspective view of a vacuum cleaner embodying the present invention, and illustrated as used for conventional dry vacuum cleaning.
Figure 2:
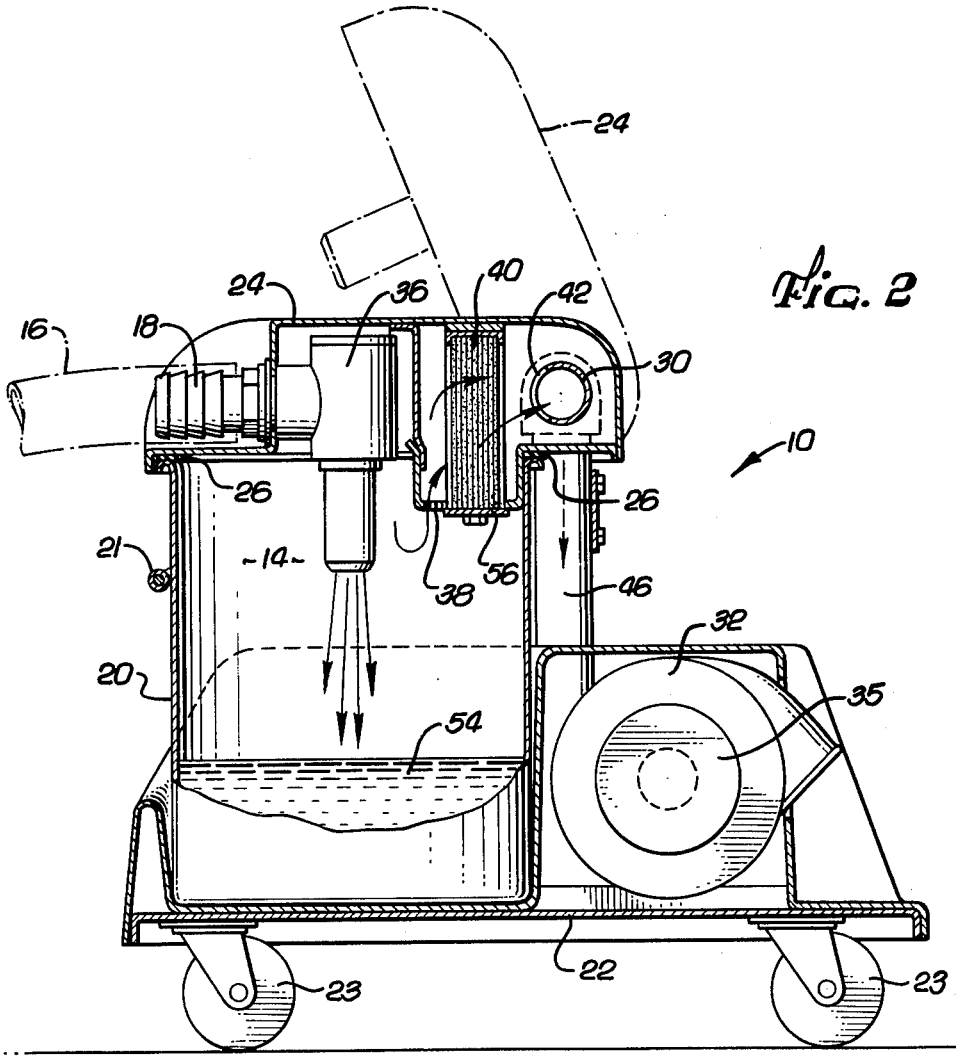
FIG. 2 is an enlarged, elevational view, partly in section, of the vacuum cleaner of FIG. 1, and taken generally along line 2—2 of FIG. 1.

As shown in the exemplary drawings, the present invention is embodied in a portable vacuum cleaner which is primarily intended for commercial use, but which can be easily adapted for home use, and which is indicated generally by reference numeral 10 in FIG. 1. Electrical power is supplied to the vacuum cleaner 10 through a conventional power cord 12, and the vacuum cleaner 10 is arranged to draw a vacuum in a vacuum chamber 14 (FIG. 2), which in turn draws air inwardly through a vacuum hose 16 shown in phantom line in FIG. 1. One end of the vacuum hose 16 is secured to an input nozzle 18 on the vacuum cleaner, and the other end of the vacuum hose is connected to a vacuum cleaning tool (not shown) which can be used in a conventional manner for vacuum cleaning any desired surface, such as a floor.

If desired, the vacuum cleaner 10 can be constructed in combination with a liquid cleaning solution spray applicator such as that described in U.S. Pat. No. 4,287,635. With this arrangement, the vacuum cleaner 10 can be operated as a so-called "wet" vacuum cleaner.

To form the vacuum chamber 14, a removable open top recovery tank 20 is mounted on a support structure 22 of the vacuum cleaner 10, and the recovery tank 20 is closed by a cover 24 which includes a soft peripheral seal 26 for bearing against the upper edge of the tank 20. The cover 24 is hinged to the support structure by a hollow hinge 30 so that the cover can be tipped up and away from the top of the tank 20, as shown in phantom line in FIG. 2. A vacuum fan 32 is mounted on the support structure 22 for drawing a vacuum in the vacuum chamber 14, and the support structure 22 is in turn mounted on a set of rollers or casters 23 to provide the desired mobility of the vacuum cleaner 10.

In accordance with the present invention, an intake 34 of the vacuum fan 32 (see FIGS. 3 and 4) communicates with the vacuum chamber 14 through the cover 24 and through the hollow hinge 30, thereby accomplishing this necessary connection without having to provide a fitting through the wall of the recovery tank 20, and permitting the fan and its heavy motor 35 to be located in a relatively low position on the support structure 22. With this arrangement, the vacuum cleaner 10 is afforded a low center of gravity making the vacuum cleaner 10 easy to handle in moving about the work area. Further, this arrangement permits the recovery tank 20, which can simply be a steel or plastic pail, to be easily and conveniently removed from the vacuum cleaner and emptied of soiled material. Moreover, the vacuum cleaner 10 of the present invention is relatively inexpensive to manufacture, is touble-free and reliable in use, and can easily be adapted for use in cleaning either wet or dry surfaces.

When a vacuum is drawn in the vacuum chamber 14, air is drawn into the recovery tank 20 through the vacuum hose 16, the nozzle 18 and an elbow 36 which directs the air and accompanying soil downwardly into the recovery tank 20. As indicated by the air hose in FIG. 2, air is withdrawn from the vacuum chamber 14 through a screen 38, a filter assembly 40 mounted in the cover 24, and through an opening 42 in the hollow hinge 30. As can best be seen in FIGS. 3 and 4, the air then proceeds through the hollow hinge 30, into an elbow 44 and an upright hollow tube 46 which forms part of the support structure 22, and into the intake 34 of the vacuum fan through appropriate connections shown partly in phantom line. The air is finally exhausted to atmosphere from the vacuum fan 32 through an outlet 48.

Figure 3:
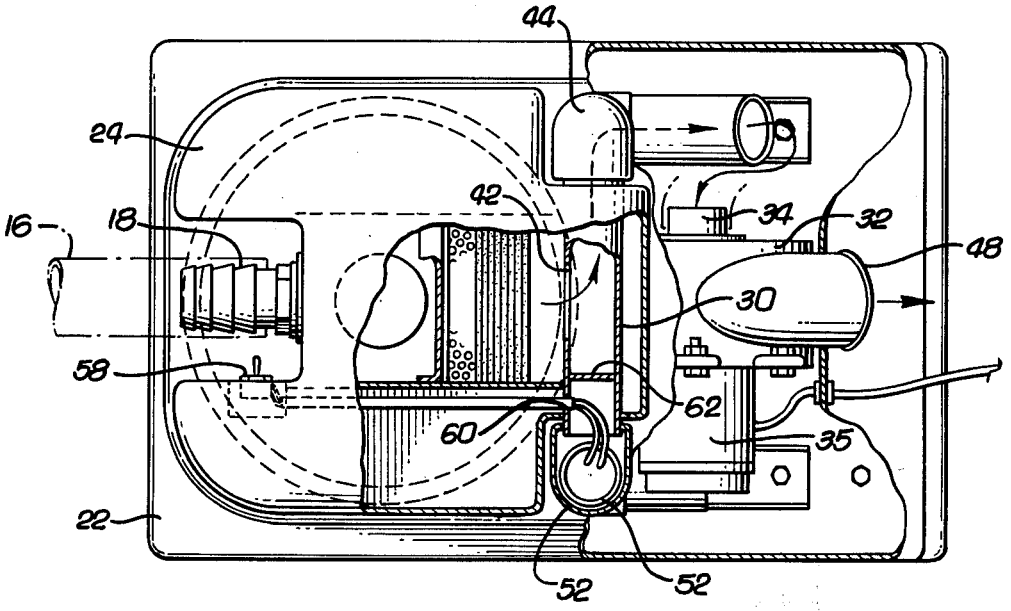
FIG. 3 is an enlarged, top plan view, partly in section, of the vacuum cleaner of FIG. 1, with portions broken away to illustrate certain details of the present invention.
Figure 4:
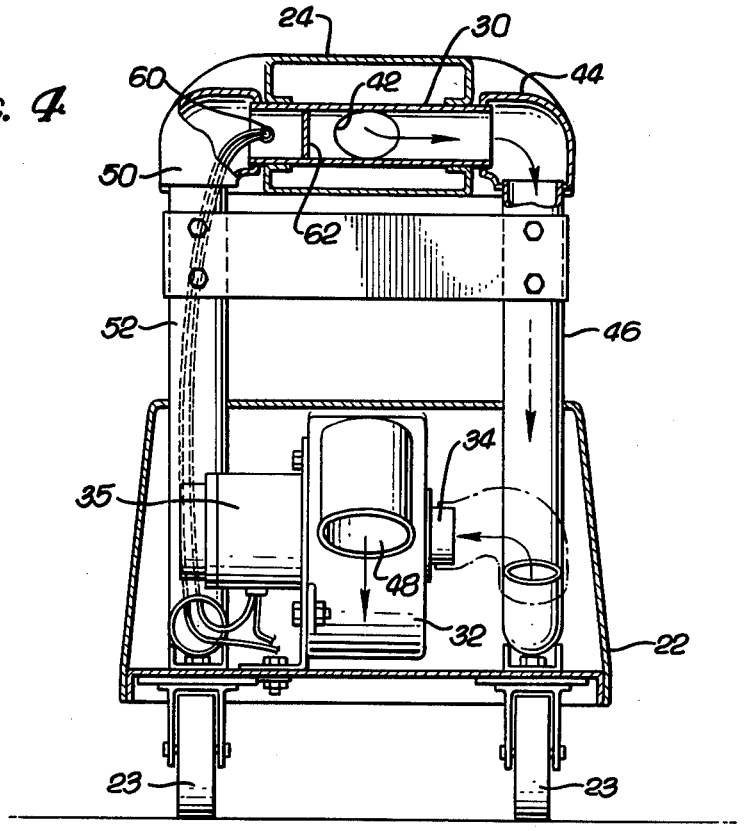
FIG. 4 is an enlarged, rear elevational view, partly in section, of the vacuum cleaner of FIG. 1, with portions broken away to illustrate further details of the present invention.

To facilitate easy removal of the recovery tank 20 for cleaning, the cover 24, as mentioned above, is pivotally mounted about the hollow hinge 30 which is retained at either end in elbows 44 and 50 mounted atop the upright hollow tubes 46 and 52 (see FIGS. 3 and 4). With this arrangement, the cover 24 can be rotated up and away from the recovery tank 20 as shown in phantom line in FIG. 2, and the tank can be lifted from the vacuum cleaner, as by a handle 21. Moreover, when the tank 20 is replaced in the vacuum cleaner and the cover 24 is returned to its operating position, as shown in full line in FIG. 2, the vacuum drawn in the vacuum chamber during operation holds the cover 24 tightly against the upper edge of the tank 20 thereby providing the desired air-tight seal between the cover and the tank.

If desired, the recovery tank 20 can be provided with a quantity of water or other liquid 54 to help retain particles of soil within the tank during operation of the vacuum cleaner 10. Even when this is done, the filter assembly 40 will eventually need to be cleaned or replaced. To accomplish this, the filter assembly 40, which is retained in the cover 24 by any suitable means such as be retaining plate 56, can be removed downwardly from the cover when the cover is in its upright position as illustrated in phantom line in FIG. 2. It should be noted that with this arrangement, the filter assembly 40 will be removed from the cover directly above the recovery tank 20 thereby causing any soil which may fall from the filter during removal to fall into the recovery tank, permitting easy and convenient disposal of the filter assembly.

The vacuum cleaner 10 is preferably constructed with a control switch 58 mounted on the cover 24 for convenient access by the user of the vacuum cleaner 10. To connect the control switch 58 to the motor 35 of the vacuum fan 32, wires can be led through a second opening 60 in the hollow hinge 30 (see FIGS. 3 and 4), and through the elbow 50 and upright hollow tube 52 to the motor 35. Leading the control wiring through the hollow hinge 30 and hollow upright tube 52 permits this necessary connection to be made while presenting a neat and orderly appearance of the vacuum cleaner 10. When the hollow hinge 30 is being used for both transmission of the vacuum air and for the control wiring, a separating wall 62 is preferably inserted in the hollow hinge 30 between the portions of the hinge used for these two purposes.

From the foregoing, it wil be appreciated that the vacuum cleaner 10 of the present invention provides an apparatus from which the recovery tank 20 can be easily and conveniently removed and replaced in the vacuum cleaner without requiring the connection or disconnection of any conduits passing to or through the tank 20. Moreover, the placement of the vacuum fan 32 and its motor 35 provides a relatively low center of gravity for the vacuum cleaner 10 thereby enhancing the ease of handling the vacuum cleaner about the work area. Further, the vacuum cleaner 10 can be fabricated conveniently and economically, and can be adapted for use for wet or dry vacuum cleaning.

While a particular form of the invention has been illustrated and described, it will be apparent that various modifications can be made without departing from the spirit and scope of the invention.

I claim:

1. A vacuum cleaner comprising:

a support structure;

an open recovery tank for receiving soiled material to be retained in said vacuum cleaner, said tank being releasably mounted in said structure;

a cover on said tank having a seal for cooperating with the periphery of said open top, forming a vacuum chamber in said tank, said cover being hinged to said support structure by a hollow hinge means;

a fan mounted on said support structure, said fan having an air inlet and an air outlet;

a first passage through said cover for permitting said soiled material to pass into said vacuum chamber; and a second passage through said cover placing said inlet of said fan in communication with said vacuum chamber, a portion of said second passage being comprised of said hollow hinge means.

2. A vacuum cleaner as set forth in claim 1 further including a filter means in said cover interposed in said second passage between said vacuum chamber and said hollow hinge means.

3. A vacuum cleaner as set forth in claim 2 wherein said filter means is removable from said cover directly above said recovery tank thereby causing any soil which may fall from said filter means during such removal to fall into said recovery tank.

4. A vacuum cleaner as set forth in claim 1 wherein said support structure includes a base mounted on rolling means and said fan is located on said base.

5. A vacuum cleaner as set forth in claim 1 wherein said fan is driven by a motor, a control for said motor is located on said cover, said control communicating with said motor, in part, through said hollow hinge means.

6. A vacuum cleaner as set forth in claim 1 wherein said recovery tank is a generally cylindrical pail which stands loosely in said support structure and includes a handle to facilitate manual removal from and insertion into said support structure.

7. A vacuum cleaner comprising:

a support structure;

an open-faced recovery tank for receiving soiled material to be retained in said vacuum cleaner, said tank being releasably mounted in said structure;

means for closing said tank and thereby forming a vacuum chamber therein;

means for drawing air out of said vacuum chamber, said drawing means being mounted on said support structure;

an inlet passage through said closing means for permitting soiled material to pass into said vacuum chamber;

an outlet passage through said closing means, said outlet passage providing an air flow path for placing said drawing means in communication with said vacuum chamber; and means for pivoting said closing means, said pivoting means defining a portion of said air flow path.

8. A vacuum cleaner as set forth in claim 7 including filter means interposed in said outlet passage between said vacuum chamber and said pivoting means.

9. A vacuum cleaner as set forth in claim 8 wherein said filter means is removable from said closing means directly above said recovery tank thereby causing any soil which may fall from said filter means during such removal to fall into said recovery tank.

10. A vacuum cleaner as set forth in claim 7 including a control for said drawing means located on said closing means, said control communicating with said drawing means, in part, through said pivoting means.

11. A vacuum cleaner as set forth in claim 7 wherein said recovery tank is a generally cylindrical pail which stands loosely in said support structure and includes a handle to facilitate manual removal from and insertion into said support structure.

12. A vacuum cleaner as set forth in claim 7 wherein said pivoting means includes a hollow hinge which attaches said closing means to said support structure.

13. A vacuum cleaner supported on a movable base, said vacuum cleaner comprising:

an open-faced recovery tank for receiving soiled material to be retained in said vacuum cleaner, said tank being releasably mounted in the movable base;

means for closing said tank and thereby forming a vacuum chamber therein;

a fan mounted on the movable base, said fan having an air inlet and an air outlet;

a first passage through said closing means for permitting soiled material to pass into said vacuum chamber;

a second passage through said closing means placing said inlet of said fan in communication with said vacuum chamber;

a hollow hinge providing a point of attachment for said closing means to the movable base, the interior of said hollow hinge forming a portion of said second passage; and means for filtering soil from the air exiting said closing means, said filtering means being interposed in said second passage between said vacuum chamber and said hollow hinge.

14. A vacuum cleaner as set forth in claim 13 wherein said filtering means is removable from said vacuum cleaner directly above said recovery tank thereby causing any soil which may fall from said filtering means during such removal to fall into said recovery tank.

15. A vacuum cleaner a set forth in claim 13 wherein said fan is driven by a motor, and a control for said motor is located on said closing means, said control communicating with said motor, in part, through said hollow hinge.

16. A vacuum cleaner as set forth in claim 13 wherein said recovery tank is a generally cylindrical pail which stands loosely in the movable base and includes a handle to facilitate manual removal from and insertion into the movable base.

* * * * *

UNITED STATES PATENT AND TRADEMARK OFFICE

CERTIFICATE OF CORRECTION

PATENT NO. : 4,463,474

DATED : August 7, 1984

INVENTOR(S) : Paul G. Jacobs

It is certified that error appears in the above-identified patent and that said Letters Patent are hereby corrected as shown below:

In column 1, line 49, delete "soilded" and insert therefor --soiled--.

In column 3, line 42, "be" should read --by --.

In column 4, line 20, after the words "an open" insert --top--.

Signed and Sealed this

*Twenty-sixth* Day of *March 1985*

[SEAL]

*Attest:*

DONALD J. QUIGG

*Attesting Officer*

*Acting Commissioner of Patents and Trademarks*